US006969958B2

(12) United States Patent
Henry

(10) Patent No.: US 6,969,958 B2
(45) Date of Patent: Nov. 29, 2005

(54) SQUARE WAVE DRIVE SYSTEM

(75) Inventor: George C. Henry, Simi Valley, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

(21) Appl. No.: 10/463,280

(22) Filed: Jun. 17, 2003

(65) Prior Publication Data

US 2004/0032223 A1 Feb. 19, 2004

Related U.S. Application Data

(60) Provisional application No. 60/392,333, filed on Jun. 27, 2002, provisional application No. 60/389,618, filed on Jun. 18, 2002.

(51) Int. Cl.[7] ..... H05B 37/02
(52) U.S. Cl. ..... 315/291; 315/224; 315/DIG. 2
(58) Field of Search ..... 315/224, 291, 315/307, 209 PZ, DIG. 2, DIG. 4, DIG. 7, 315/219, 244

(56) References Cited

U.S. PATENT DOCUMENTS 4,544,863 A * 10/1985 Hashimoto ..... 315/224
5,235,254 A * 8/1993 Ho ..... 315/219
5,410,221 A * 4/1995 Mattas et al. ..... 315/307
5,539,281 A 7/1996 Shackle et al. ..... 315/224
5,612,594 A * 3/1997 Maheshwari ..... 315/224
5,652,479 A 7/1997 LoCascio et al. ..... 315/225
5,744,915 A * 4/1998 Nilssen ..... 315/219
5,770,925 A * 6/1998 Konopka et al. ..... 315/225
5,818,172 A 10/1998 Lee ..... 315/86
5,923,129 A 7/1999 Henry ..... 315/307
5,930,121 A * 7/1999 Henry ..... 315/307
6,002,210 A 12/1999 Nilssen ..... 315/219
6,137,240 A 10/2000 Bogdan ..... 315/307
6,150,772 A 11/2000 Crane ..... 315/291
6,181,084 B1 1/2001 Lau ..... 315/291
6,198,234 B1 3/2001 Henry ..... 315/291
6,351,080 B1 * 2/2002 Birk et al. ..... 315/224
6,630,797 B2 * 10/2003 Qian et al. ..... 315/224
6,724,602 B2 * 4/2004 Giannopoulos ..... 361/111

* cited by examiner

*Primary Examiner*—Wilson Lee
*Assistant Examiner*—Ephrem Alemu
(74) *Attorney, Agent, or Firm*—Knobbe, Martens, Olson & Bear, LLP

(57) ABSTRACT

A power conversion circuit improves lamp operating life and lamp efficiency by driving a fluorescent lamp with a square wave signal. The square wave signal is an alternating current signal with relatively fast transition times. The square wave signal advantageously reduces lamp current crest factor for more efficient operation of the fluorescent lamp.

27 Claims, 9 Drawing Sheets

SQUARE WAVE DRIVE SYSTEM

CLAIM FOR PRIORITY

This application claims the benefit of priority under 35 U.S.C. § 119(e) of U.S. Provisional Application No. 60/389,618 entitled "Lamp Inverter with Pre-Regulator," filed on Jun. 18, 2002, and U.S. Provisional Application No. 60/392,333 entitled "Square Wave Drive System," filed on Jun. 27, 2002, the entirety of which are incorporated herein by reference.

RELATED APPLICATION

Applicant's copending U.S. Patent Application entitled "Lamp Inverter with Pre-Regulator," filed on the same day as this application, is hereby incorporated by reference herein.

BACKGROUND OF THE INVENTION

1. Field of the Invention

The present invention relates to a power conversion circuit for driving fluorescent lamps, such as, for example, cold cathode fluorescent lamps or hot cathode fluorescent lamps, and more particularly relates to a lamp inverter using square wave signals for more efficient operation.

2. Description of the Related Art

Fluorescent lamps are used in a number of applications where light is required but the power required to generate the light is limited. For example, fluorescent lamps are used for back lighting or edge lighting of liquid crystal displays (LCDs), which are typically used in display systems for flat panel computer monitors, notebook computers, hand held computers, LCD television, web browsers, automotive and industrial instrumentation, and entertainment systems. The fluorescent lamps in the display systems need to have long life and high operating efficiency.

A power conversion circuit is generally used for driving a fluorescent lamp. The power conversion circuit accepts a direct current (DC) input voltage and provides an alternating current (AC) output voltage to the fluorescent lamp. The power conversion circuit typically uses resonant drive methods, and the AC output voltage is a sinusoidal waveform.

One problem with a sinusoidal waveform is that lamp efficiency may be poor. Lamp efficiency in terms of light output versus power provided to the fluorescent lamp degrades with increasing lamp current crest factor. The lamp current crest factor is defined as a ratio of the peak lamp current level to the root mean square (RMS) lamp current level. The light output of the fluorescent lamp is proportional to the RMS lamp current level and is inversely proportional to the lamp current crest factor.

A pure sine wave has a crest factor of approximately 1.414. Many power conversion circuits with resonant topologies achieve lamp current crest factors in the range of 1.5 to 1.6. A pure DC waveform provides a lowest possible crest factor of 1.0. However, a DC lamp current is not viable because the operating life of the fluorescent lamp is shortened due to mercury migration.

SUMMARY OF THE INVENTION

One embodiment of the present invention is a power conversion circuit that improves lamp operating life and lamp efficiency by driving a fluorescent lamp with a square wave signal (or a rectangular wave signal). The square wave signal is an AC signal with relatively fast transition times (e.g., fast rise or fall times). For example, the transition times for a 50 kilohertz square wave signal may be in the range of one to two microseconds. In one embodiment, the transition times are less than one-twentieth of a period of the square wave signal.

A square wave signal advantageously reduces lamp current crest factor for more efficient operation of a fluorescent lamp. For example, a lamp current crest factor associated with a square wave voltage provided to a fluorescent lamp can be in the range of 1.0 to 1.2. In one embodiment, the lamp efficiency improves by more than 20% when a square wave signal, rather than a sinusoidal signal, is provided to drive the fluorescent lamp.

In one embodiment, the power conversion circuit includes a pulse width modulation (PWM) controller (or a square wave controller) and a switching network (or a drive network). The switching network can employ a full-bridge topology, a half-bridge topology, or other switching topologies that generate square wave signals. The switching network is coupled to a substantially DC supply voltage and generates a square wave voltage in response to control signals (or driving signals) from the square wave controller. The switching network can be realized with semiconductor switches, such as field-effect-transistors (FETs). The driving signals from the square wave controller are provided to gate terminals of the respective FETs.

In one embodiment, the square wave voltage is directly coupled from the semiconductor switches to a fluorescent lamp connected in series with an AC coupling capacitor, which also operates as a DC blocking capacitor. The DC blocking capacitor ensures that DC current does not flow through the fluorescent lamp. The direct coupling of the semiconductor switches to the fluorescent lamp facilitates low operating frequencies (e.g., as low as 100 hertz). Low operating frequencies improve lamp current crest factor because the rise and fall times of the square wave voltage are relatively short in comparison to the pulse width (or period).

In another embodiment, the switching network includes an output transformer for coupling to the fluorescent lamp. For example, semiconductor switches are coupled to a primary winding of the output transformer, and the fluorescent lamp is coupled to a secondary winding of the output transformer. The output transformer has relatively low leakage inductance, relatively low secondary distributed capacitance, and relatively tight primary to secondary coupling. In one embodiment, the square wave voltage across the secondary winding of the output transformer has relatively fast transition times (e.g., less than one-twentieth of the period) and relatively small overshoots (e.g., less than 5%) to reduce lamp current crest factor for efficient operation.

In one embodiment, the power conversion circuit further includes a regulator (e.g., a boost regulator or a buck regulator). The regulator provides a desired supply voltage over a wide input voltage range. For example, a boost regulator provides a relatively high supply voltage to help strike and operate a fluorescent lamp, especially in topologies that directly couple semiconductor switches to the fluorescent lamp. In topologies with step-up transformers that couple the semiconductor switches to the fluorescent lamp, the supply voltage can be relatively lower. The fluorescent lamp can provide illumination in a display system for a flat panel computer monitor, a notebook computer, a hand held computer, or a liquid crystal display television.

In one embodiment, the power conversion circuit further includes a feedback circuit that senses a current corresponding to current flowing through the fluorescent lamp (i.e., lamp current). The feedback circuit can be coupled to the fluorescent lamp or to the switching network. The feedback circuit provides a feedback signal indicative of the lamp current level. The feedback signal can be used to adjust duty cycles of the driving signals to the switching network or to adjust the level of the supply voltage provided by the regulator to achieve a desired brightness.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE INVENTION

Figure 1:
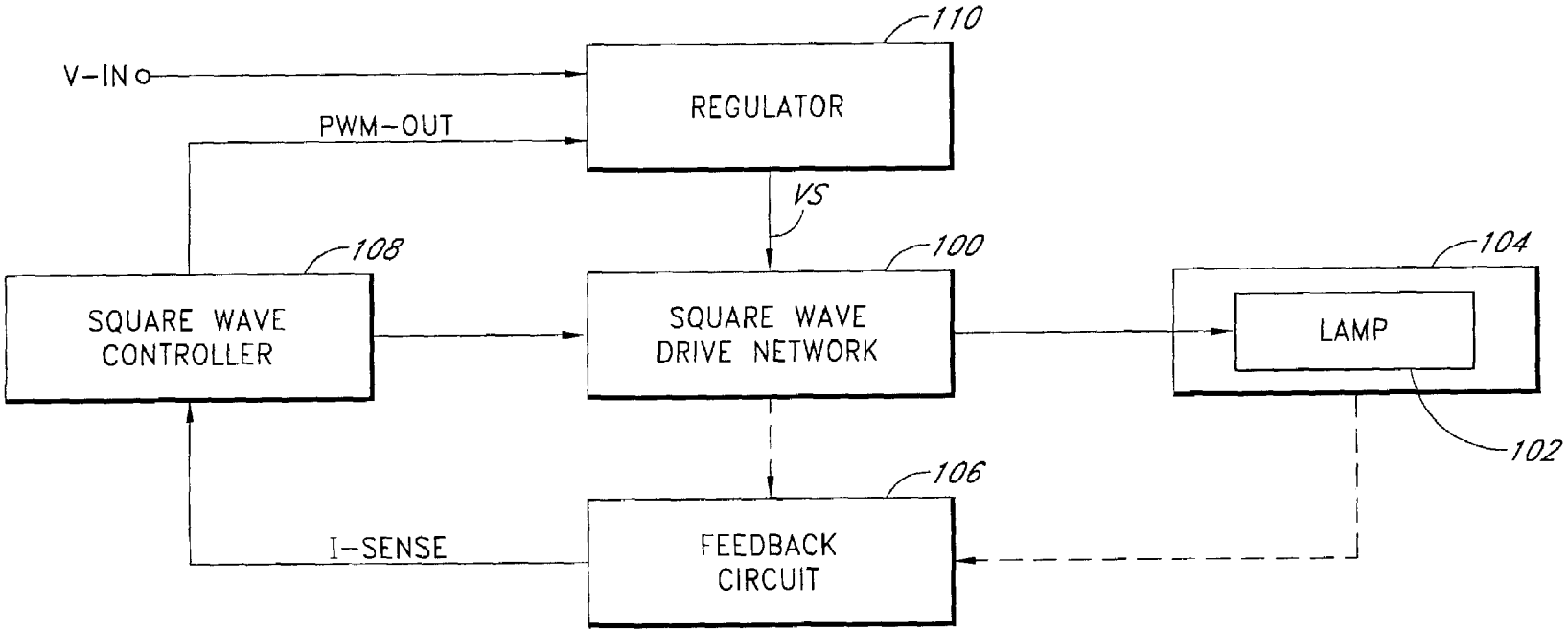
FIG. 1 is a block diagram of a power conversion circuit according to one embodiment of the present invention.

Embodiments of the present invention will be described hereinafter with reference to the drawings. FIG. 1 is a block diagram of a power conversion circuit (or a lamp inverter) according to one embodiment of the present invention. The power conversion circuit converts a substantially DC input voltage (V-IN) into a substantially square wave output voltage to drive a fluorescent lamp (e.g., a cold cathode fluorescent lamp (CCFL) or a hot cathode fluorescent lamp (HCFL)) 102. A lamp current flows through the fluorescent lamp 102 to provide illumination in an electronic device 104, such as, for example, a flat panel display, a notebook computer, a personal digital assistant, a hand held computer, a liquid crystal display television, a scanner, a facsimile machine, a copier, or the like.

The power conversion circuit includes a regulator 110, a square wave controller 108, a square wave drive network 100, and a feedback circuit 106. The regulator (or the input stage voltage regulator or the pre-regulator) 110 accepts the input voltage and a control signal (PWM-OUT) from the square wave controller 108 to produce a regulated voltage or a supply voltage (VS). The supply voltage is provided to the square wave drive network (or the switching network) 100. The square wave drive network 100 is controlled by control signals (or driving signals) provided by the square wave controller 108 and produces the square wave output voltage to drive the fluorescent lamp 102.

The square wave output voltage is an AC signal with relatively fast transition times (e.g., fast rise or fall times). For example, the transition times for a 50 kilohertz square wave output voltage may be in the range of one to two microseconds. In one embodiment, the transition times are less than one-twentieth of a period of the square wave output voltage. A square wave output voltage advantageously reduces lamp current crest factor for more efficient operation of a fluorescent lamp. For example, a lamp current crest factor associated with providing a square wave output voltage to a fluorescent lamp can be in the range of 1.0 to 1.2. In one embodiment, the lamp efficiency improves by more than 20% when a square wave output voltage, rather than a sinusoidal voltage, is provided to drive the fluorescent lamp 102.

The feedback circuit 106 can be coupled to the fluorescent lamp 102 or to the square wave drive network 100 to generate a feedback signal (I-SENSE) for the square wave controller 108. The square wave controller 108 can adjust the control signal to the regulator 110, adjust the driving signals to the square wave drive network 100 or adjust the control signal and the driving signals in response to the feedback signal. In one embodiment, the feedback signal provides an indication of the RMS level of the lamp current, which determines the brightness of the fluorescent lamp 112. The RMS lamp current level is a function of the supply voltage level and the pulse widths of the driving signals for the square wave drive network 100. For example, the pulse widths (or the duty cycles) of the driving signals or the supply voltage level can be varied to vary the RMS lamp current level, thereby controlling the brightness of the fluorescent lamp 102.

Figure 2:
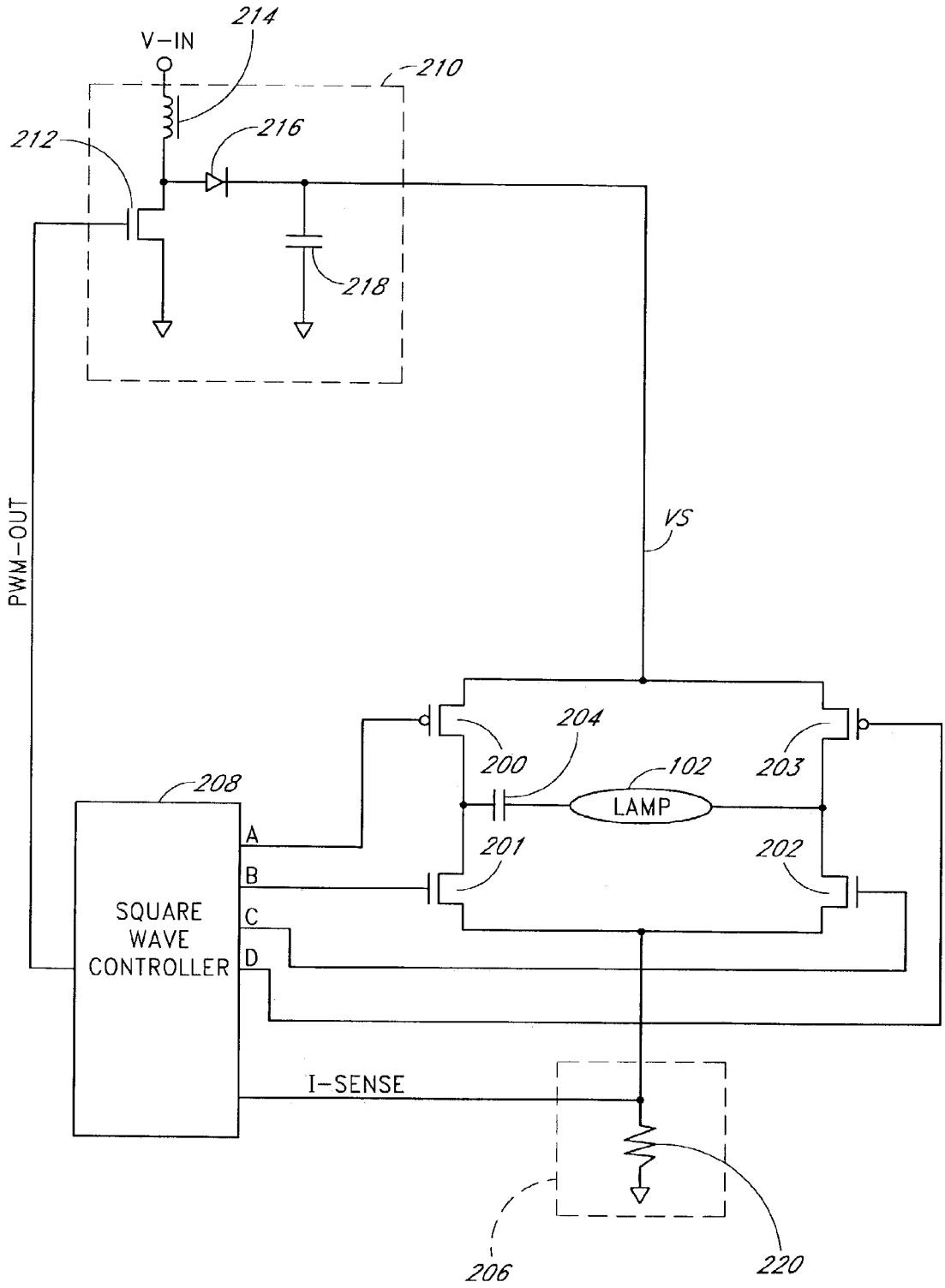
FIG. 2 is a circuit diagram of one embodiment of a power conversion circuit using a full-bridge switching topology and direct coupling to a fluorescent lamp.

FIG. 2 is a circuit diagram of one embodiment of a power conversion circuit using a full-bridge switching topology and direct coupling to a fluorescent lamp 102. In this embodiment, the square wave drive network 100 is realized with four semiconductor switches 200, 201, 202, 203 configured in a full-bridge topology. The semiconductor switches 200, 201, 202, 203 are high voltage switches capable of withstanding high voltages sufficient to strike or operate the fluorescent lamp 102.

In one embodiment, the semiconductor switches 200, 203 are p-type FETs (P-FETs) with respective source terminals commonly connected to a supply voltage (VS) as shown in FIG. 2. The semiconductor switches 200, 203 can alternately be n-type FETS (N-FETs) with respective drain terminals commonly connected to the supply voltage and with a suitable drive voltage for the control terminals. In the embodiment of FIG. 2, the semiconductor switches 201, 202 are N-FETs with respective source terminals that are commonly connected and coupled through a resistor 220 to ground. The respective drain terminals of the semiconductor switches 200, 201 are commonly connected to provide a first output of the full-bridge square wave drive network. The respective drain terminals of the semiconductor switches 202, 203 are commonly connected to provide a second output of the full-bridge square wave drive network.

In one embodiment, the outputs of the full-bridge square wave drive network are directly coupled to the fluorescent lamp 102 (e.g., coupled without a transformer). For example, the outputs of the full-bridge square wave drive network are coupled to the fluorescent lamp 102 connected in series with an AC coupling capacitor 204, which operates as a DC blocking capacitor. The DC blocking capacitor 204 ensures that DC current does not flow through the fluorescent lamp 102.

The semiconductor switches 200, 201, 202, 203 are controlled by respective driving signals A, B, C, D provided by a square wave controller 208. The semiconductor switches 200, 201, 202, 203 of the full-bridge square wave drive network alternately conduct in pairs to provide a square wave signal across the fluorescent lamp 102. For example, the semiconductor switches 200, 202 are closed (or on), and the second pair of semiconductor switches 201, 203 are opened (or off) to provide a voltage of a first polarity (e.g., +VS) across the fluorescent lamp 102. Then, the semiconductor switches 200, 202 are opened, and the semiconductor switches 201, 203 are closed to provide a voltage of a second polarity (e.g., −VS) across the fluorescent lamp 102. The square wave controller 208 controls the opening and closing of the semiconductor switches 200, 201, 202, 203 to generate a square wave voltage across the fluorescent lamp 102 with relatively fast transition times between the voltage of the first polarity and the voltage of the second polarity. In the embodiment of FIG. 2, the amplitude of the square wave voltage across the fluorescent lamp 102 is approximately the same as the level of the supply voltage. It should be understood that the square wave controller 208 provides an adequate amount of time (e.g., dead time) between opening one pair of switches and closing the other pair of switches to assure that no direct path from the supply voltage to ground is provided.

The fast transition times of the square wave voltage reduce lamp current crest factor to improve lamp efficiency. The lamp efficiency can also be improved by lowering the operating frequency, which reduces the lamp current crest factor. The direct coupling of the semiconductor switches 200, 201, 202, 203 to the fluorescent lamp 102 facilitates low operating frequencies (e.g., as low as 100 hertz). Low operating frequencies improve lamp current crest factor because the rise and fall times of the square wave voltage across the fluorescent lamp 102 are relatively short in comparison to the pulse width (or period).

In one embodiment, the power conversion circuit further includes a regulator to provide the supply voltage to the full-bridge square wave drive network. The regulator advantageously maintains a desired supply voltage over a wide input voltage range. For example in FIG. 2, a boost regulator 210 provides a relatively high supply voltage (VS) to help strike and operate the fluorescent lamp 102. The power conversion circuit of FIG. 2 is cost efficient for driving small fluorescent lamps (e.g., cold cathode fluorescent lamps) that have relatively low striking and operating voltages (e.g., less than 1,000 volts). In one embodiment, the boost regulator 210 provides a supply voltage ranging from 200 volts to 600 volts to power a relatively small fluorescent lamp (e.g., approximately one inch in length) that strikes at approximately 400 volts and that operates at approximately 200 volts.

In one embodiment, the boost regulator 210 includes an input inductor 214, a switching transistor 212, an isolation diode 216 and an output capacitor 218. The input inductor 214 is coupled in series with the switching transistor 212 between the input voltage (V-IN) and ground. An anode of the isolation diode 216 is coupled to a common node of the switching transistor 212 and the input inductor 214. A cathode of the isolation diode 226 is coupled to an output of the boost regulator 210. The output capacitor 218 is coupled between the output of the boost regulator 210 and ground.

In one embodiment, the square wave controller 208 outputs a variable pulse width control signal (PWM-OUT) to control the switching transistor 212. The square wave controller 208 uses PWM techniques to adjust the duty cycle of the control signal to the switching transistor 212, thereby controlling the storage of electrical energy in the input inductor 214 and controlling the transfer of the electrical energy to the output capacitor 218. For example, current conducted by the input inductor 214 increases when the switching transistor 212 is on. When the switching transistor 212 is turned off, the current conducted by the input inductor 214 continues to flow and is provided to the output capacitor 218 and to the output of the boost regulator 210 via the isolation diode 216. The square wave controller 208 operates to achieve and to maintain a desired supply voltage at the output of the boost regulator 210. For example, the boost regulator controller 208 varies the pulse width of the control signal to adjust the supply voltage to compensate for variations in the input voltage or in response to a brightness control signal.

In one embodiment, the resistor 220 forms a feedback circuit 206 to provide an indication of the lamp current level to the square wave controller 208 for brightness control. The resistor 220 is coupled to a low voltage node of the full-bridge square wave drive network (e.g., the source terminals of the semiconductor switches 201, 202). The current flowing through the resistor 220 is substantially similar to the current flowing through the fluorescent lamp 102 since the full-bridge square wave drive network is directly coupled to the fluorescent lamp 102. The voltage across the resistor 220 is a feedback signal (I-SENSE) that is used by the square wave controller 208 to adjust duty cycles of the driving signals provided to the full-bridge square wave drive network or to adjust duty cycle of the control signal provided to the boost regulator 210 to achieve a desired brightness.

Figure 3:
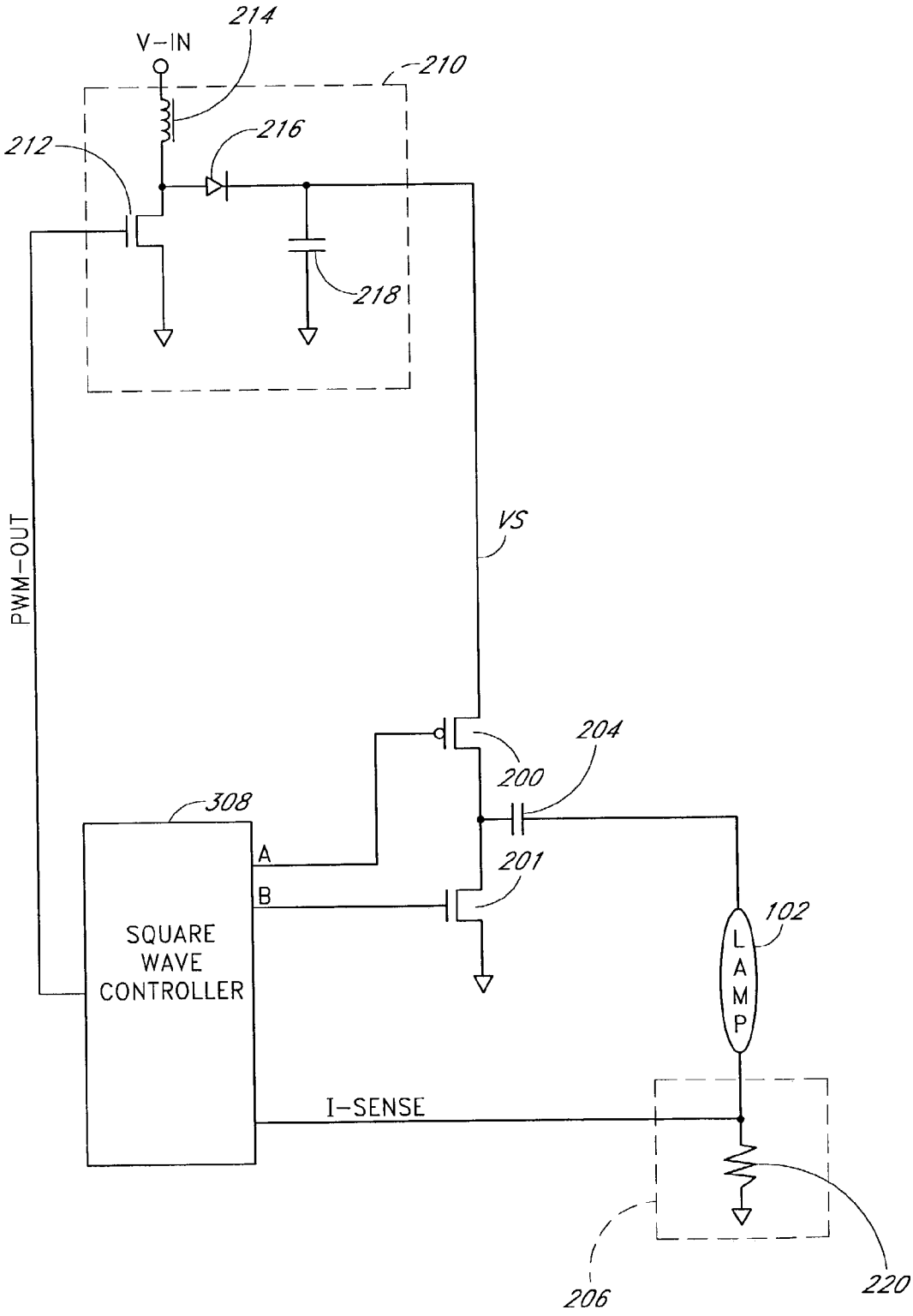
FIG. 3 is a circuit diagram of one embodiment of a power conversion circuit using a half-bridge switching topology and direct coupling to a fluorescent lamp.

FIG. 3 is a circuit diagram of one embodiment of a power conversion circuit using a half-bridge switching topology and direct coupling to a fluorescent lamp 102. In this embodiment, the square wave drive network 100 is realized with two semiconductor switches 200, 201 configured in a half-bridge topology. The semiconductor switches 200, 201 are high voltage devices capable of withstanding high voltages sufficient to strike or operate the fluorescent lamp 102.

In one embodiment, the semiconductor switch 200 is a P-FET with a source terminal coupled to a supply voltage (VS) as shown in FIG. 3. The semiconductor switch 200 can alternately be an N-FET with a drain terminal coupled to the supply voltage and with a suitable drive voltage for the control terminal. In the embodiment of FIG. 3, the semiconductor switch 201 is an N-FET with a drain terminal coupled to a drain terminal of semiconductor switch 200 and a source terminal coupled to ground.

The commonly connected drain terminals of the semiconductor switches 200, 201 are directly coupled (e.g., coupled without a transformer) to the fluorescent lamp 102 via an AC coupling capacitor 204. The AC coupling capacitor 204 prevents DC current from flowing in the fluorescent lamp 102. The AC coupling capacitor 204 also effectively splits the supply voltage to provide a square wave voltage to the fluorescent lamp 102 with an amplitude that is approximately half of the level of the supply voltage.

For example, the semiconductor switches 200, 201 are controlled by respective driving signals A, B from a square wave controller 308, which is advantageously substantially similar to the square wave controller 208 of FIG. 2, but uses only two of the driving signals. The semiconductor switches 200, 201 alternately conduct to generate a square wave voltage alternating between ground and the supply voltage (VS) at a node connecting an input terminal of the capacitor 204 to the commonly drain terminals of the semiconductor switches 200, 201. The capacitor 204 blocks the DC component of the square wave such that the voltage at an output terminal of the capacitor 204, which is connected to a first terminal of the fluorescent lamp 102, is a square wave voltage alternating between approximately −VS/2 and approximately +VS/2.

As discussed above, the square wave voltage provided to the fluorescent lamp 102 is characterized by relatively fast transition times to reduce lamp current crest factor and to improve lamp efficiency. In one embodiment, a resistor 220 is coupled between a second terminal (or low voltage terminal) of the fluorescent lamp 102 and ground to sense current flowing through the fluorescent lamp 102. The resistor 220 is a part of a feedback circuit 206, and the voltage across the resistor 220 is provided as a feedback signal (I-SENSE) to the square wave controller 308. The square wave controller 308 uses the feedback signal to control brightness of the fluorescent lamp 102.

In one embodiment, the power conversion circuit further includes a regulator (e.g., a boost regulator) to provide the supply voltage to the half-bridge square wave drive network. The boost regulator 210 shown in FIG. 3 is substantially similar to the boost regulator 210 shown in FIG. 2 and is not discussed in further detail.

Figure 4:
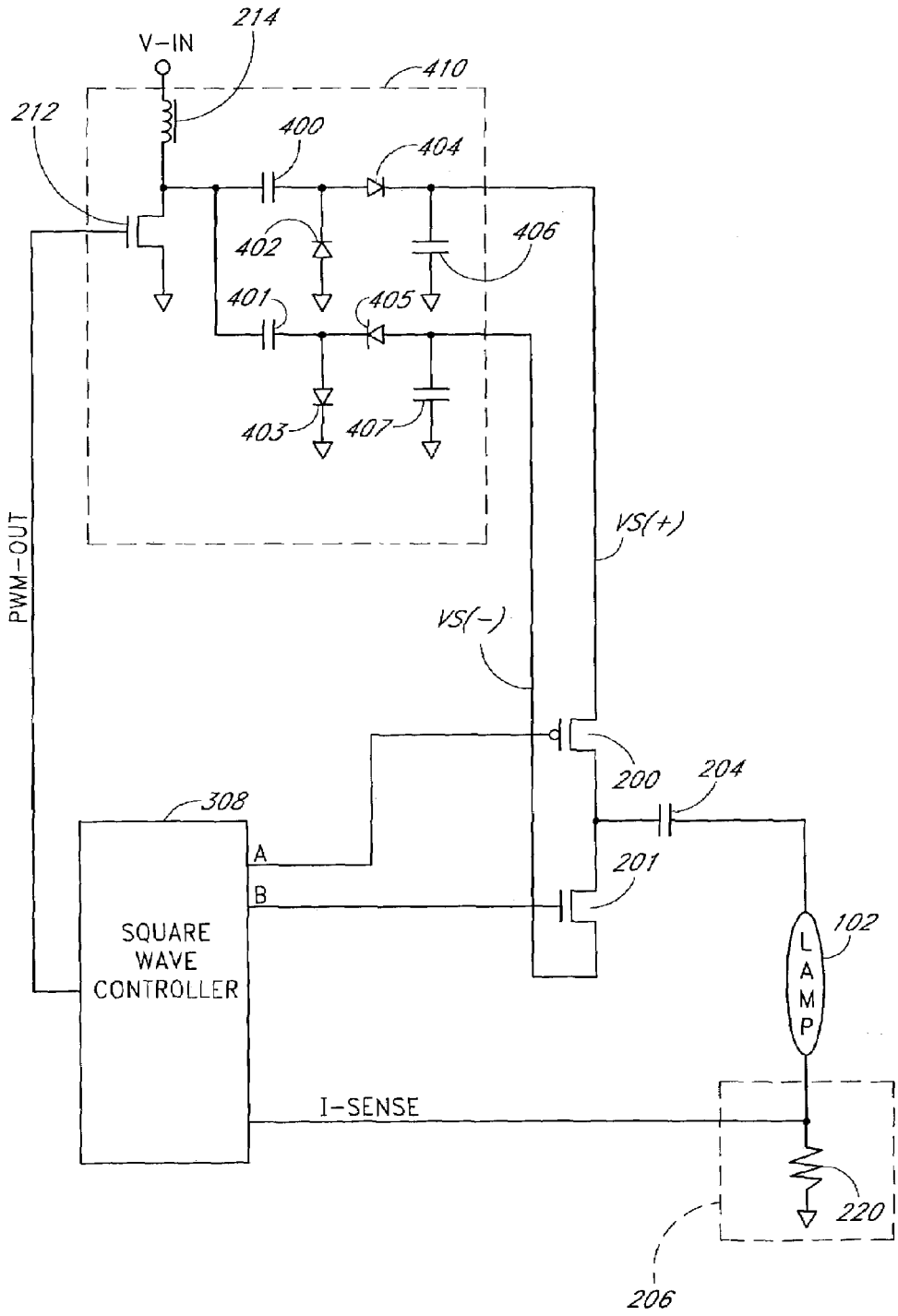
FIG. 4 is a circuit diagram of one embodiment of a half-bridge, direct-coupled power conversion circuit that has dual supply voltages.

FIG. 4 is a circuit diagram of one embodiment of a half-bridge, direct-coupled power conversion circuit that has dual supply voltages. Some applications (e.g., audio systems) use dual supply voltages. In the embodiment of FIG. 4, a dual supply regulator 410 provides complimentary voltages (VS(+), VS(−)) to a half-bridge square wave drive network. Aside from the dual supply regulator 410, other components shown in FIG. 4 are substantially similar to corresponding components shown in FIG. 3 and are not discussed in further detail.

In one embodiment, the dual supply regulator 410 is a boost regulator that includes an input inductor 214 and a switching transistor 212. An input voltage (V-IN) is provided to a first terminal of the input inductor 214. A second terminal of the input inductor 214 is coupled to a common node. In one embodiment, the switching transistor 212 is an N-FET with a drain terminal coupled to the common node, a source terminal coupled to ground, and a gate terminal configured to receive a control signal (PWM-OUT) from the square wave controller 308. The switching transistor 212 alternately conducts to produce a varying voltage at the common node with a desired amplitude. The AC component of the varying voltage is provided to two rectifying networks coupled in parallel to produce the respective complimentary voltages at the outputs of the dual supply regulator 410.

In one embodiment, the first rectifying network includes a first AC coupling capacitor 400, a first clamping diode 402, a first rectifying diode 404, and a first holding capacitor 406. The first AC coupling capacitor 400 is connected between the common node and a first internal node to couple the AC component of the varying voltage at the common node to the first internal node. The first clamping diode 402 has an anode coupled to ground and a cathode coupled to the first internal node to determine the low level of the voltage at the first internal node. The first rectifying diode 404 has an anode coupled to the first internal node and a cathode coupled to the first output of the dual supply regulator 410. The first rectifying diode 404 rectifies the AC voltage at the first internal node to produce a positive voltage at the first output of the dual supply regulator 410. The first holding capacitor 406 is coupled between the first output of the dual supply regulator 410 and ground to provide some filtering.

The second rectifying network is similar to the first rectifying network but works in an opposite polarity. The second rectifying network includes a second AC coupling capacitor 401, a second clamping diode 403, a second rectifying diode 404, and a second holding capacitor 407. The second AC coupling capacitor 401 is connected between the common node and a second internal node to couple the AC component of the varying voltage at the common node to the second internal node. The second clamping diode 403 has a cathode coupled to ground and an anode coupled to the second internal node to determine the high level of the voltage at the second internal node. The second rectifying diode 405 has a cathode coupled to the second internal node and an anode coupled to the second output of the dual supply regulator 410. The second rectifying diode 405 rectifies the AC voltage at the second internal node to produce a negative voltage at the second output of the dual supply regulator 410. The second holding capacitor 407 is coupled between the second output of the dual supply regulator 410 and ground to provide some filtering.

In the embodiment of FIG. 4, the positive voltage (VS(+)) is provided to a source terminal of a semiconductor switch 200. The negative voltage (VS(−)) is provided to a source terminal of a semiconductor switch 201 (which is coupled to ground in a single supply voltage system of FIG. 3). The square wave voltage produced by the half bridge square wave drive network fluctuates between VS(+) and VS(−) with the dual supply regulator 410. Thus, a half-bridge switching topology with dual supplies can generate square wave voltages of similar amplitude to a full-bridge switching topology with a single supply as described above in FIG. 2.

Figure 5:
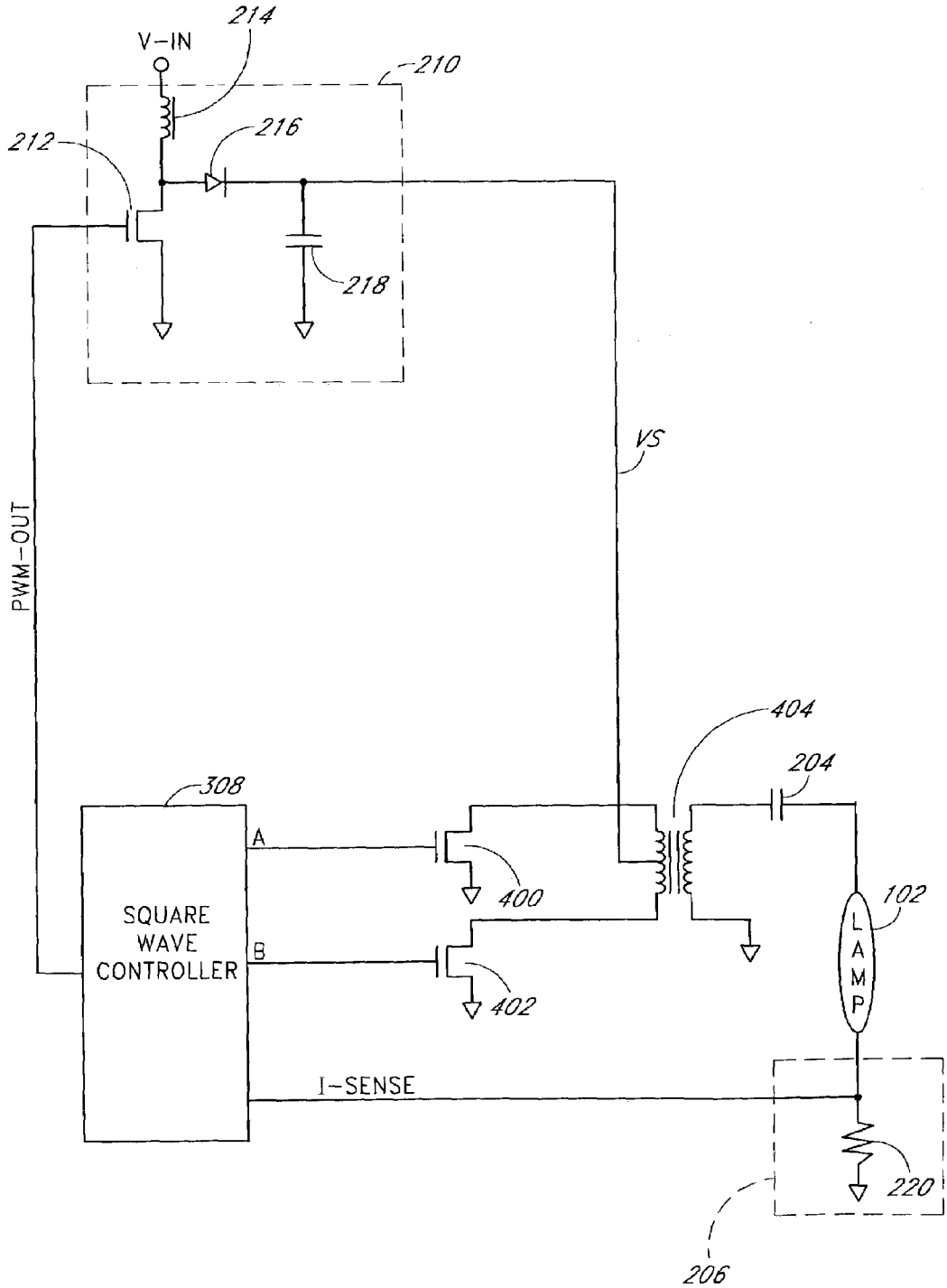
FIG. 5 is a circuit diagram of one embodiment of a power conversion circuit using transformer coupling to a fluorescent lamp.

FIG. 5 is a circuit diagram of one embodiment of a power conversion circuit using transformer coupling to a fluorescent lamp 102. In this embodiment, the square wave drive network 100 is realized with two semiconductor switches (or switching transistors) 400, 402 and a transformer 404. Aside from the square wave drive network 100, other components shown in FIG. 5 are substantially similar to corresponding components shown in FIG. 3 and are not discussed in further detail.

In one embodiment in accordance with FIG. 5, a supply voltage (VS) is provided to a center-tap of a primary winding of the transformer 404. The switching transistors 400, 402 are coupled to respective opposite terminals of the primary winding of the transformer 404 to alternately switch the respective terminals to ground. For example, the first switching transistor 400 is an N-FET with a drain terminal coupled to a first terminal of the primary winding of the transformer 404 and a source terminal coupled to ground. The second switching transistor 402 is an N-FET with a drain terminal coupled to a second terminal of the primary winding of the transformer 404 and a source terminal coupled to ground. The switching transistors 400, 402 are controlled by a square wave controller 308 through respective driving signals (A, B), which are coupled to gate terminals of the respective switching transistors 400, 402. A square wave signal on the primary winding results from alternating conduction by the switching transistor 400, 402. Other configurations to couple the supply voltage and switching transistors to the primary winding of the transformer 404 may be used to produce the square wave signal.

The square wave signal is magnetically coupled to a secondary winding of the transformer 404. A first terminal of the secondary winding of the transformer 404 is coupled to ground, and a second terminal of the secondary winding is coupled to the fluorescent lamp 102 through an AC-coupling capacitor 204. The transformer 404 has relatively low leakage inductance, relatively low secondary distributed capacitance, and relatively tight primary to secondary coupling to produce a square wave voltage across the secondary winding of the transformer 404 with relatively fast transition times (e.g., less than one-twentieth of the period) and relatively small overshoots (e.g., less than 5%). In one embodiment, the number of turns in the windings of the transformer 404 is proportionately reduced and the primary winding is wrapped on top of the secondary winding. The characteristics of the transformer 404 help reduce lamp current crest factor for efficient operation.

Figure 6:
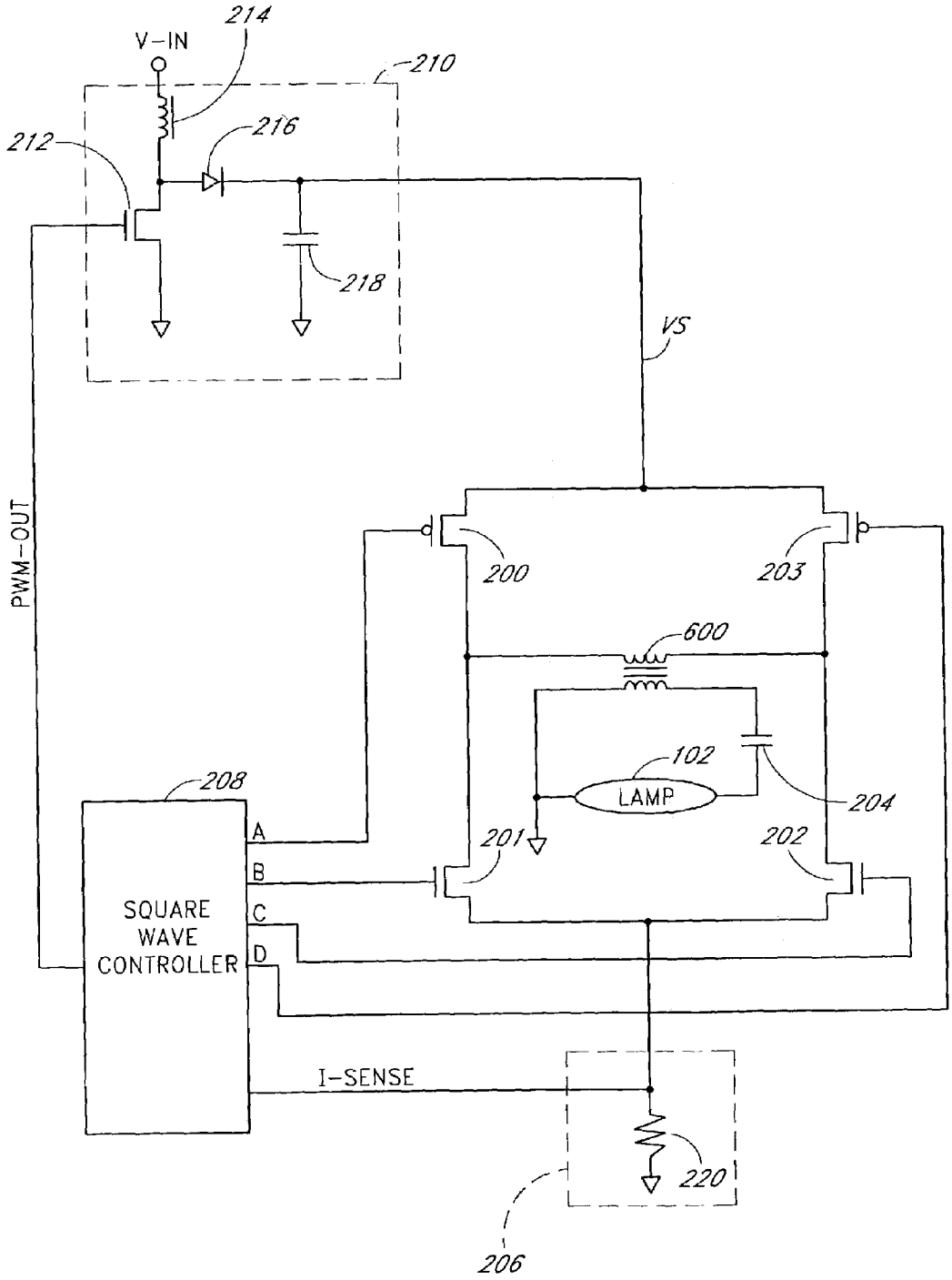
FIG. 6 is a circuit diagram of one embodiment of a power conversion circuit using a full-bridge switching topology and transformer coupling to a fluorescent lamp.

FIG. 6 is a circuit diagram of one embodiment of a power conversion circuit using a full-bridge switching topology and transformer coupling to a fluorescent lamp 102. The power conversion circuit shown in FIG. 6 is similar to the power conversion circuit shown in FIG. 2 with the exception that a transformer 600 couples the square wave voltage from the semiconductor switches 200, 201, 202, 203 to the fluorescent lamp 102. For example, the commonly connected drain terminals of the semiconductor switches 200, 201 are coupled to a first terminal of a primary winding of the transformer 600. The commonly connected drain terminals of the semiconductor switches 202, 203 are coupled to a second terminal of the primary winding of the transformer 600. The switches 200, 201, 202, 203 are controlled by the driving signals A, B, C and D from the square wave controller 208.

The fluorescent lamp 102 is coupled in series with an AC-coupling capacitor 204 across a secondary winding of the transformer 600. In one embodiment, the transformer 600 steps up the square wave voltage provided to the fluorescent lamp 102. For example, the amplitude of the square wave voltage across the secondary winding of the transformer 600 is a multiple of the amplitude of the square wave voltage across the primary winding of the transformer 600.

The transformer 600 has similar characteristics to the transformer 404 described above. Thus, the secondary winding of the transformer 600 provides a square wave voltage to the fluorescent lamp 102 to reduce lamp current crest factor for efficient operation. The transformer 600 also reduces power wasted in a magnetic core of the transformer 600, which advantageously allows lamp current to be sensed indirectly with accuracy and eliminates a need for a ground return on the secondary side of the transformer 600. For example, the ground connection shown on the secondary side of the transformer 600 can be isolated from the other ground connections shown in FIG. 6. A sensing resistor 220 is coupled to a low voltage terminal on the primary side of the transformer 600 (e.g., to the source terminals of the semiconductor switches 201, 202) to sense the lamp current indirectly. No feedback circuit to sense lamp current, and thus no ground return, is need on the secondary side of the transformer 600.

Figure 7:
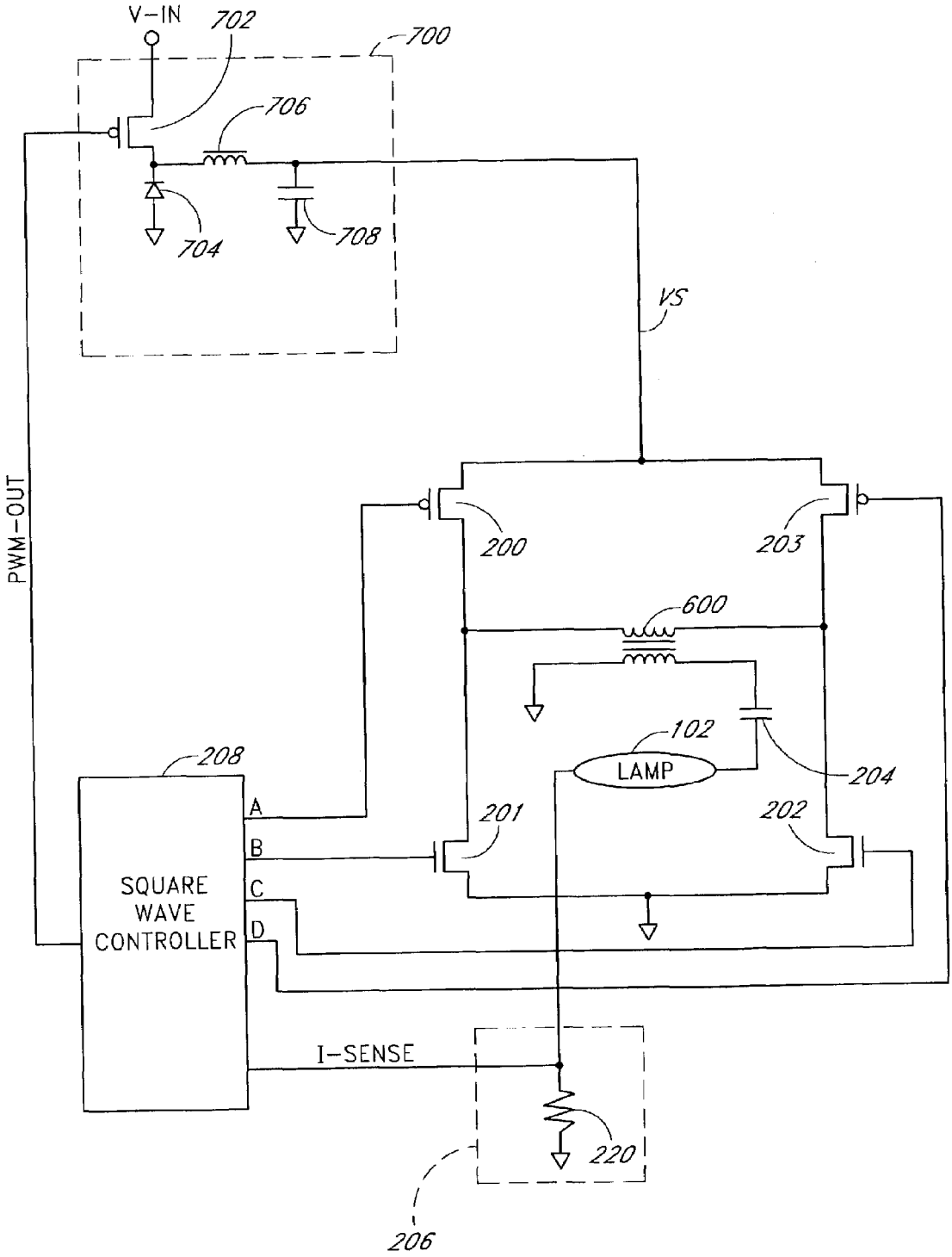
FIG. 7 is a circuit diagram of one embodiment of a full-bridge, transformer-coupled power conversion circuit that includes a buck regulator and direct lamp current sensing.

FIG. 7 is a circuit diagram of another embodiment of a full-bridge, transformer-coupled power conversion circuit. The power conversion circuit shown in FIG. 7 illustrates connection of a feedback circuit 206 to the fluorescent lamp 102 to sense lamp current directly. In one embodiment, a sensing resistor 220 in the feedback circuit 206 is coupled in series with the fluorescent lamp 102 to directly sense the current flowing through the fluorescent lamp 102. The voltage across the sensing resistor 220 is provided as a feedback signal (I-SENSE) to a square wave controller 208. The power conversion circuit shown in FIG. 7 is similar to the power conversion circuit shown in FIG. 6 except for the connection of the feedback circuit 206 described above and a buck regulator 700 replaces the boost regulator 210. Thus, the following discussion focuses on the buck regulator 700.

The buck regulator 700 accepts an input voltage (V-IN) and provides a supply voltage (VS) to the square wave drive network 100. In one embodiment, the buck regulator 700 includes a primary switch (e.g., a semiconductor switch) 702 coupled between the input voltage and an intermediate node. A cathode of a diode (e.g., a rectifying diode or a zener diode) 704 is also coupled to the intermediate node. An anode of the diode 704 is coupled to ground. An inductor 706 is coupled between the intermediate node and an output of the buck regulator 700. A capacitor 708 is coupled between the output of the buck regulator 700 and ground.

In one embodiment, the primary switch 702 is a P-FET and the square wave controller 208 provides a control signal (PWM-OUT) to a gate terminal of the primary switch 702. The square wave controller 208 controls the duty cycle of the control signal to the primary switch 702 to control the current flowing through the inductor 706, thus controlling the supply voltage level. Current flows through the inductor 706 from the input voltage when the primary switch 702 is closed and from the diode 704 when the primary switch 702 is opened. The capacitor 708 controls the ripple voltage at the output of the buck regulator 700.

The buck regulator 700 steps down the input voltage. The buck regulator 700 can compensate for input voltage fluctuations and can also provide dimming control of the fluorescent lamp 102. For example, the square wave controller 208 alters the duty cycles of the control signal to the buck regulator 700 to adjust the level of the supply voltage to achieve a desired brightness. An increase in the on-time duty cycles of the control signal increases the average supply voltage level while a decrease in the on-time duty cycles of the control signal decreases the average supply voltage level. In one embodiment, the average level of the supply voltage at the output of the buck regulator 700 is lower than the lowest input voltage level for a desired range of lamp brightness (or a dimming range) and is relatively independent of the input voltage level under normal operating conditions.

Figure 8:
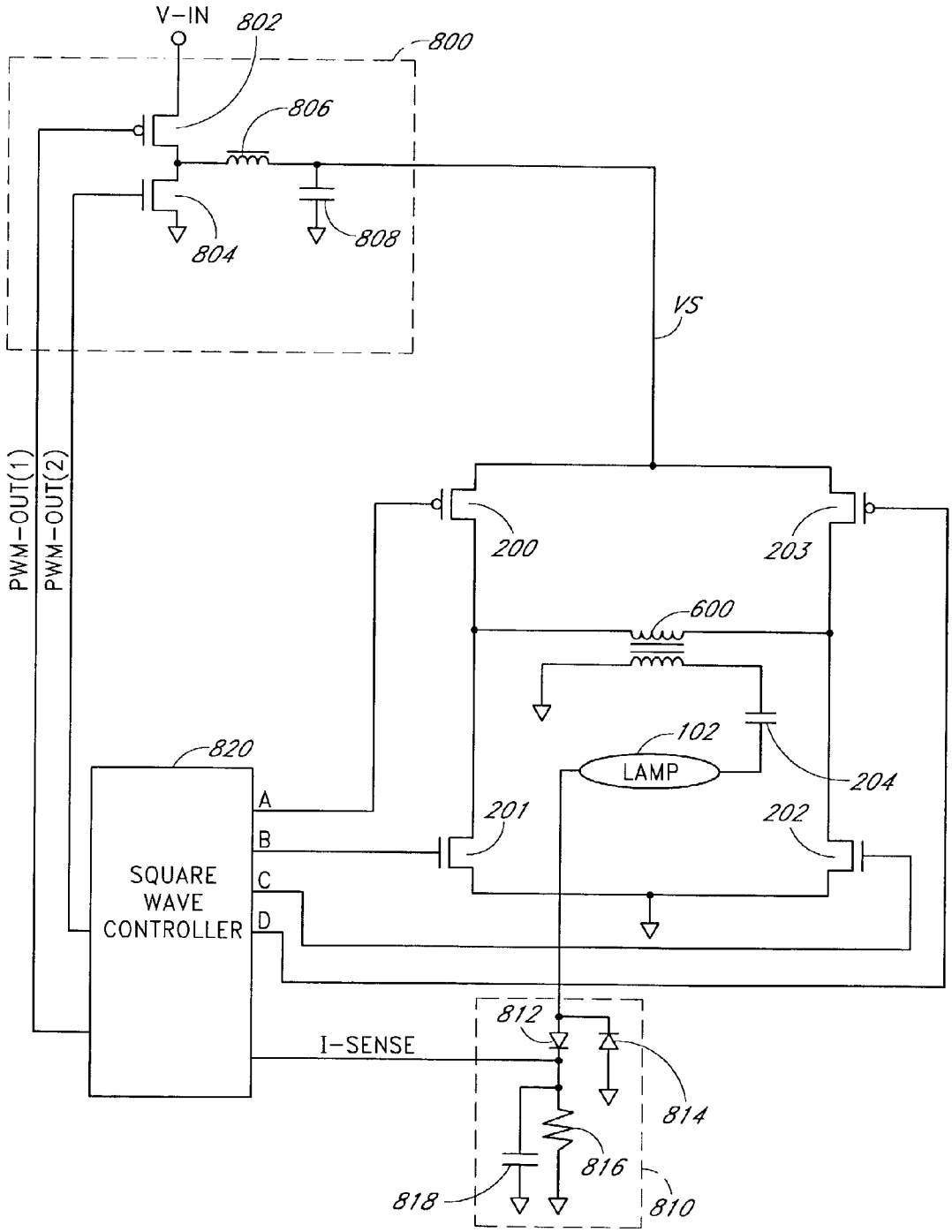
FIG. 8 illustrates alternate embodiments for a buck regulator and a feedback circuit.

FIG. 8 illustrates alternate embodiments for circuits shown in FIG. 7. The power conversion circuit of FIG. 8 illustrates an alternate embodiment of a buck regulator 800 which accepts an input voltage (V-IN) and provides a supply voltage (VS) to a square wave drive network 100. An alternate embodiment of a feedback circuit 810 is coupled in series with a fluorescent lamp 102 to sense current flowing through the fluorescent lamp 102. The feedback circuit 810 generates a feedback voltage (I-SENSE) that is provided to a square wave controller 820. The square wave controller 820 provides driving signals (A, B, C, D) to the square wave drive network 100. The square wave controller 820 also provides control signals (PWM-OUT(1), PWM-OUT(2)) to the buck regulator 800.

The buck regulator 800 functions substantially similar to the buck regulator 700 of FIG. 7 to provide the supply voltage to the square wave drive network 100. In one embodiment, the buck regulator 800 includes switching transistors 802, 804 and an output filter. The square wave controller 820 uses PWM techniques to generate the control signals (PWM-OUT(1), PWM-OUT(2)) to control the switching transistors 802, 804 respectively. For example, the control signals are provided to gate terminals of the respective switching transistors 802, 804. The first switching transistor 802 is a P-FET with a source terminal coupled to the input voltage and a drain terminal coupled to a common node. The second switching transistor 212 is an N-FET with a drain terminal coupled to the common node and a source terminal coupled to ground. In one embodiment, the output filter is an LC circuit that includes an inductor 806 and a capacitor 808. The inductor 806 is coupled between the common node and the output of the buck regulator 800. The capacitor 808 is coupled between the output of the buck regulator 800 and ground.

The feedback circuit 810 is coupled in series with the fluorescent lamp 102 to provide an indication of the lamp current to the square wave controller 820. In one embodiment, the feedback circuit 810 includes diodes 812, 814, a current sensor (or a resistor) 816 and a capacitor 818. The fluorescent lamp 102 is coupled to an anode of the diode 812 and a cathode of the diode 814. An anode of the diode 814 is coupled to ground. A cathode of the diode 812 is coupled to a first terminal of the resistor 816. A second terminal of the resistor 322 is coupled to ground. The capacitor 818 is coupled in parallel with the resistor 816.

Current flowing through the resistor 816 results in a sense voltage (I-SENSE) across the resistor 816. The sense voltage is provided to the square wave controller 820. The diode 812 operates as a half-wave rectifier such the sense voltage that develops across the resistor 816 is responsive to the lamp current passing through the fluorescent lamp 102 in one direction. The diode 814 provides a current path for the alternate half-cycles when the lamp current flows in another direction. The capacitor 818 provides filtering such that the sense voltage indicates an average level of the lamp current.

Figure 9:
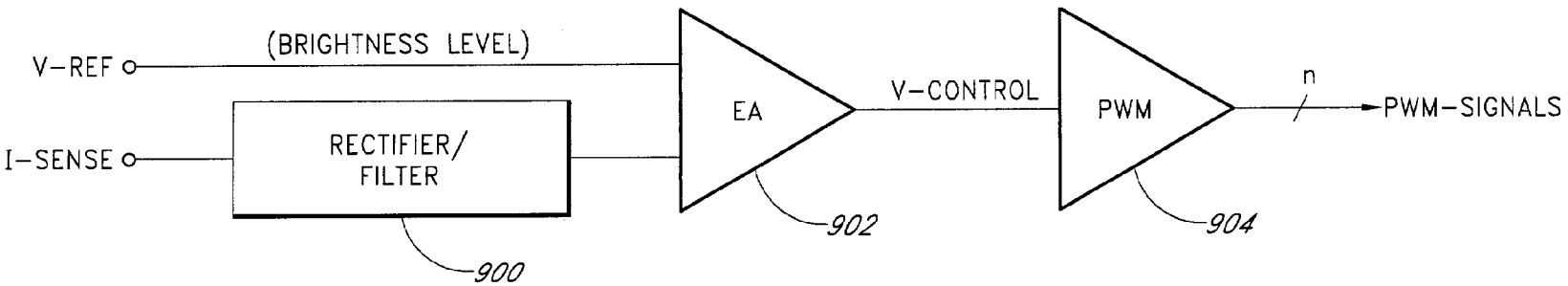
FIG. 9 is a block diagram of one embodiment of a control circuit for adjusting brightness of a fluorescent lamp.

FIG. 9 is a block diagram of one embodiment of a control circuit for adjusting the brightness of a fluorescent lamp 102. The control circuit can be part of the square wave controller 208. In one embodiment, the control circuit uses PWM techniques and includes a rectifier/filter 900, an error amplifier (EA) 902, and a PWM circuit 904. The rectifier/filter 900 receives the feedback signal (I-SENSE) indicative of the lamp current and provides an output to the error amplifier 902. In addition to the output from the rectifier/filter 900, the error amplifier 902 receives a reference voltage (V-REF) corresponding to a desired brightness level. The error amplifier 902 outputs a PWM control voltage (V-CONTROL) for the PWM circuit 904.

The PWM circuit 904 generates one or more PWM signals (PWM-SIGNALS) which may be used as control signals for regulators or as driving signals for the square wave drive network 100. The PWM signals at the respective outputs of the PWM circuit 904 are variable duty cycle signals. The PWM control voltage at the input of the PWM circuit 904 is compared with a periodic triangular or a periodic ramp voltage (a periodic reference voltage) to determine the duty cycles or pulse widths of the respective control signals. For example, the PWM signals are in a first state during the time that the periodic reference voltage is below the PWM control voltage and transition to a second state when the periodic reference voltage is above the PWM control voltage. The duty cycles of the PWM signals change in proportion to an amplitude change in the PWM control voltage.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A power conversion circuit for driving a fluorescent lamp, the circuit comprising:

a voltage regulator configured to receive a substantially direct current input voltage of a first level and to generate a substantially direct current regulated voltage of a second level;

a switching network configured to receive the regulated voltage and to generate a square wave voltage using at least two semiconductor switches, wherein the square wave voltage is directly coupled from the semiconductor switches to a fluorescent lamp connected in series with an AC coupling capacitor such that a voltage waveform across the fluorescent lamp is approximately the same as the square wave voltage;

a feedback circuit configured to provide a feedback signal indicative of the current flowing through the fluorescent lamp; and a controller configured to receive the feedback signal and to provide driving signals to the switching network and to the voltage regulator.

2. The power conversion circuit of claim 1, wherein the second level is substantially greater than the first level.

3. The power conversion circuit of claim 1, wherein the square wave voltage for driving the fluorescent lamp has rise and fall times that are each less than one-twentieth of a period of the square wave voltage.

4. The power conversion circuit of claim 1, wherein the feedback circuit senses current flowing through the switching network to generate the feedback signal indicative of the current flowing through the fluorescent lamp.

5. The power conversion circuit of claim 1, wherein the controller comprises:

a filter circuit to condition the feedback signal for comparison with a substantially direct current voltage;

an error amplifier configured to compare the conditioned feedback signal with a reference voltage and to generate a control voltage; and a pulse width modulation circuit configured to generate driving signals with pulse widths determined by the level of the control voltage.

6. The power conversion of claim 1, wherein duty cycles of the driving signals to the switching network are variable in response to the feedback signal.

7. The power conversion circuit of claim 1, wherein the fluorescent lamp is configured to provide illumination in a display system for a flat panel computer monitor, a notebook computer, a hand held computer, or a liquid crystal display television.

8. A lamp inverter comprising:

a pulse width modulation controller configured to output driving signals;

a half bridge switching network coupled to a supply voltage and configured to generate a square wave voltage in response to the driving signals; and a direct current blocking capacitor and a fluorescent lamp connected in series and directly coupled to the half bridge switching network such that a voltage across the fluorescent lamp is approximately the same as the square wave voltage.

9. The lamp inverter of claim 8, further comprising a boost regulator configured to generate the supply voltage.

10. The lamp inverter of claim 9, wherein the boost regulator has dual outputs to provide complimentary polarities for the supply voltage.

11. The lamp inverter of claim 8, further comprising a feedback circuit coupled in series with the fluorescent lamp to sense a lamp current flowing through the fluorescent lamp and to provide a feedback signal indicative of the lamp current level to the pulse width modulation controller.

12. The lamp inverter of claim 11, wherein the pulse width modulation controller adjust duty cycles of the driving signals in response to the feedback signal to achieve a desired brightness for the fluorescent lamp.

13. A fluorescent lighting system with improved efficiency, comprising:

means for generating a regulated voltage with a predetermined level;

means for receiving the regulated voltage and generating a square wave voltage to drive a fluorescent lamp, wherein the square wave voltage is directly coupled from a switching network to the fluorescent lamp connected in series with an AC coupling capacitor such that a voltage across the fluorescent lamp is approximately the same as the square wave voltage;

means for sensing a lamp current corresponding to current flowing through the fluorescent lamp; and means for controlling brightness of the fluorescent lamp based on the lamp current.

14. The fluorescent lighting system of claim 13, wherein the means for controlling brightness of the fluorescent lamp adjusts the level of the regulated voltage to maintain a desired current through the fluorescent lamp.

15. The fluorescent lighting system of claim 13, wherein the means for controlling brightness of the fluorescent lamp adjusts the duty cycle of the square wave voltage.

16. A lamp inverter comprising:

a pulse width modulation controller configured to output driving signals;

a full bridge switching network coupled to a supply voltage and configured to generate a square wave voltage in response to the driving signals; and a direct current blocking capacitor and a fluorescent lamp connected in series and directly coupled to the full bridge switching network.

17. The lamp inverter of claim 16, further comprising a buck regulator configured to accept an input voltage and to generate the supply voltage, wherein the level of the supply voltage is less than the level of the input voltage.

18. The lamp inverter of claim 16, further comprising a boost regulator configured to accept an input voltage and to generate the supply voltage, wherein the level of the supply voltage is greater than the level of the input voltage.

19. The lamp inverter of claim 18, wherein the boost regulator comprises:

an inductor coupled between the input voltage and an intermediate node;

a semiconductor switch coupled between the intermediate node and ground;

an isolation element coupled between the intermediate node and the supply voltage; and a capacitor coupled between the supply voltage and ground.

20. The lamp inverter of claim 16, further comprising a current sensing circuit configured to provide an indication of brightness for the fluorescent lamp.

21. The lamp inverter of claim 20, wherein the current sensing circuit is a sensing resistor coupled in series with the fluorescent lamp.

22. The lamp inverter of claim 20, wherein the current sensing circuit is a sensing resistor coupled to the full bridge switching network.

23. A method for improving lamp lighting efficiency, the method comprising the steps of:

supplying a substantially direct current supply voltage to a switching network;

providing driving signals to semiconductor switches in the switching network to produce a square wave voltage; and coupling the square wave voltage directly from the semiconductor switches to a fluorescent lamp connected in series with a DC blocking capacitor to generate light, wherein a voltage signal across the fluorescent lamp is approximately the same as the square wave voltage.

24. The method of claim 23, wherein the substantially direct current supply voltage is generated by a boost regulator and the fluorescent lamp is a cold cathode fluorescent lamp.

25. The method of claim 23, wherein the fluorescent lamp is a hot cathode fluorescent lamp.

26. The method of claim 23, further comprising the steps of:

sensing a lamp current corresponding to current flowing through the fluorescent lamp; and providing an indication of the lamp current level to a controller that generates the driving signals, wherein the controller adjusts pulse widths of the driving signals to achieve a desired lamp current.

27. The method of claim 23, further comprising the steps of:

regulating an input voltage to generate the substantially direct current supply voltage;

sensing a lamp current corresponding to current flowing through the fluorescent lamp; and providing an indication of the lamp current level to a controller that generates a control signal for adjusting the level of the substantially direct current supply voltage to achieve a desired brightness for the fluorescent lamp.

* * * * *